US005125799A

United States Patent [19]

Sato et al.

[11] Patent Number: 5,125,799

[45] Date of Patent: Jun. 30, 1992

[54] IMPELLER STRUCTURE FOR PUMP

[75] Inventors: Kenichi Sato; Yasuo Mitsui, both of Kanagawa, Japan

[73] Assignee: Atsugi Unisia Corporation, Japan

[21] Appl. No.: 615,387

[22] Filed: Nov. 19, 1990

[30] Foreign Application Priority Data

Nov. 22, 1989 [JP] Japan ..... 1-303964

[51] Int. Cl.[5] ..... F01D 5/14

[52] U.S. Cl. ..... 416/178; 416/183; 416/223 B

[58] Field of Search ..... 416/182, 183, 185, 187, 416/178, 223 R, 223 B

[56] References Cited

U.S. PATENT DOCUMENTS

| | | | |
|---|---|---|---|
| 809,711 | 1/1906 | Maier | 416/183 |
| 867,874 | 10/1907 | Capell | 416/183 |
| 2,065,716 | 12/1936 | Leonard | 416/183 |
| 2,962,207 | 11/1960 | Mayne | 416/DIG. 3 |
| 4,115,030 | 9/1978 | Inagaki et al. | 416/DIG. 3 |

FOREIGN PATENT DOCUMENTS

| | | | |
|---|---|---|---|
| 521295 | 8/1955 | Belgium | 416/183 |
| 466300 | 10/1928 | Fed. Rep. of Germany | 416/223 B |
| 2617029 | 12/1976 | Fed. Rep. of Germany | 416/DIG. 2 |
| 217586 | 1/1985 | Fed. Rep. of Germany | 416/182 |
| 889341 | 1/1944 | France | 416/183 |
| 244989 | 12/1925 | United Kingdom . | |
| 253302 | 6/1926 | United Kingdom . | |
| 280749 | 11/1927 | United Kingdom . | |
| 517293 | 1/1940 | United Kingdom . | |
| 556375 | 10/1943 | United Kingdom . | |
| 578053 | 6/1946 | United Kingdom . | |
| 894893 | 4/1962 | United Kingdom | 416/183 |
| 1059869 | 2/1967 | United Kingdom . | |
| 1105320 | 3/1968 | United Kingdom . | |
| 1144445 | 3/1969 | United Kingdom . | |
| 1495708 | 12/1977 | United Kingdom . | |
| 1515729 | 6/1978 | United Kingdom . | |

*Primary Examiner*—John T. Kwon
*Attorney, Agent, or Firm*—Ronald P. Kananen

[57] ABSTRACT

In a pump impeller structure employing a plurality of vanes arranged on the periphery of an impeller hub in a substantially radial direction of a pump shaft having a driving connection with the impeller, each vane including a particular geometry of a pressure surface therein. The pressure surface is formed concave in such a manner as to increase an angle defined between two tangential lines on a point of the pressure surface, form the innermost end of the vane to the outermost end of the vane, one tangential line being perpendicular to a straight line drawn in the radial direction of the impeller from the center of the pump shaft to the point on the pressure surface and the other tangential line being drawn along the contour of the pressure surface, both of the tangential lines being included in a same rotational plane of the vane. The pressure surface lying at the outermost end of the vane is located downstream of a point of the pressure surface lying at the innermost end of the vane, with regard to a rotational direction of the impeller.

6 Claims, 3 Drawing Sheets

IMPELLER STRUCTURE FOR PUMP

BACKGROUND OF THE INVENTION

1. Field of the Invention

The present invention relates to an impeller structure for pumping devices, such as a water pump for circulating cooling water in water jackets provided in cylinder blocks of an internal combustion engine.

2. Description of the Prior Disclosure

Conventionally, a water pump having a rotating impeller as shown in FIGS. 1 and 2 is well known. Such impeller type water pump is comprised of a pump body 2 fixed at the front end of a cylinder block 1 between the block and a radiator (not shown), a pump impeller 6, a rotating shaft 3 securely connected to the impeller 6, a bearing 4 disposed in the bore of the pump body 2 so as to rotatably receive the shaft 3. One end of the shaft 3 is secured at the center portion of a pulley 5, having a driven connection with an engine crankshaft, so as to transmit torque to the impeller 6. The impeller 6 is fixed on the other end of the shaft 3. In this construction, the impeller rotates about the axis of the shaft 3 in a direction shown in the arrow D of FIG. 2, with the result that fluid for engine cooling, for example water, is fed from a pump inlet A to a pump outlet B.

The above described conventional impeller 6 arrangement will be described in detail with reference to FIG. 2. The impeller 6 is comprised of a hub section 7 for mounting the impeller body at the other end of the shaft 3 and a plurality of vanes 8 extending from the outer periphery of the hub section in a substantially radial direction of the shaft. As clearly seen in FIG. 2, the pressure surface of each of the vanes 8 is formed in such a manner that the pressure surface is moderately curved from the innermost end of the vane to the outermost end of the vane, downstream in the rotational direction of the impeller 6. As seen in FIG. 2, the pressure surface of the vane 8 is formed convex. Such a conventional impeller has an outlet angle $\beta_2$ defined between a tangential line in a circumferential direction of the impeller 6 and another tangential line of the pressure surface at the outermost end of the vane 8. As seen in FIG. 2, an angle defined between the above mentioned two tangential lines is formed in a substantially same manner at any pressure surface of the vane 8, that is, at a whole range from the innermost end of the vane to the outermost end of the vane. In a conventional water pump impeller, the outlet angle $\beta_2$ is generally set to a value of approximately 60°.

However, the aforementioned conventional impeller having vanes, each having an outlet angle of approximately 60° provides a relatively low pump efficiency as defined by a ratio of fluid power to pump input power, for example 30%. This is because the input angle, i.e., the approach angle to the fluid is a relatively large angle, such as 60°. This results in energy loss of rotation of the impeller. If the approach angle is decreased simply, characteristic for catching fluid mass may also be lowered. Therefore, it is desirable to enhance catching characteristic for fluid mass without lowering rotational energy loss of the impeller for providing a high pump efficiency.

SUMMARY OF THE INVENTION

It is therefore, in view of the above disadvantages, an object of the present invention to provide an impeller structure for pumping devices having a high pump efficiency.

It is another object of the invention to provide an impeller structure for pumping devices which is capable of reducing rotational energy loss of the impeller and enhancing catching characteristic for fluid mass pumped by the impeller vanes.

It is a further object of the invention to provide a compact impeller type pump having a high pump efficiency.

In order to accomplish the aforementioned and other objects, an impeller structure comprises a plurality of vanes arranged on an impeller body in a substantially radial direction of a pump shaft having a driving connection with the impeller; each of the vanes including a pressure surface being formed in such a manner as to increase an angle defined between two tangential lines on a point of the pressure surface, from the innermost end of the vane to the outermost end of the vane, one tangential line being perpendicular to a straight line drawn in the radial direction of the impeller from the center of the pump shaft to the point on the pressure surface and the other tangential line being drawn along the contour of the pressure surface, both of the tangential lines being included in a same rotational plane of the vane.

The pressure surface is arranged such that a point of the pressure surface lying at the outermost end of the vane is located downstream of a point of the pressure surface lying at the innermost end of the vane, with regard to a rotational direction of the impeller. The pressure surface faces in the rotational direction of the impeller. The pressure surface may be formed concave in a manner so as to be curved from the innermost end of the vane to the outermost end of the vane. An outlet angle defined between both of the tangential lines at the outermost end of the vane is desirably set to an angle of approximately 90°, while an inlet angle defined between both of the tangential lines at the innermost end of the vane is desirably set to an angle approximately two times smaller than the outlet angle.

According to another aspect of the invention, a pump impeller structure comprises a plurality of vanes arranged on an impeller body in a substantially radial direction of a pump shaft having a driving connection with the impeller; each of the vanes including a pressure surface having an outlet angle of approximately 90°, the outlet angle being defined between two tangential lines on a point of the pressure surface lying at the outermost end of the vane, one tangential line being perpendicular to a straight line drawn in the radial direction of the impeller from the center of the pump shaft to the point on the pressure surface and the other tangential line being drawn along the contour of the pressure surface, both of the tangential lines being included in a same rotational plane of the vane.

DESCRIPTION OF THE PREFERRED EMBODIMENT

Figure 1:
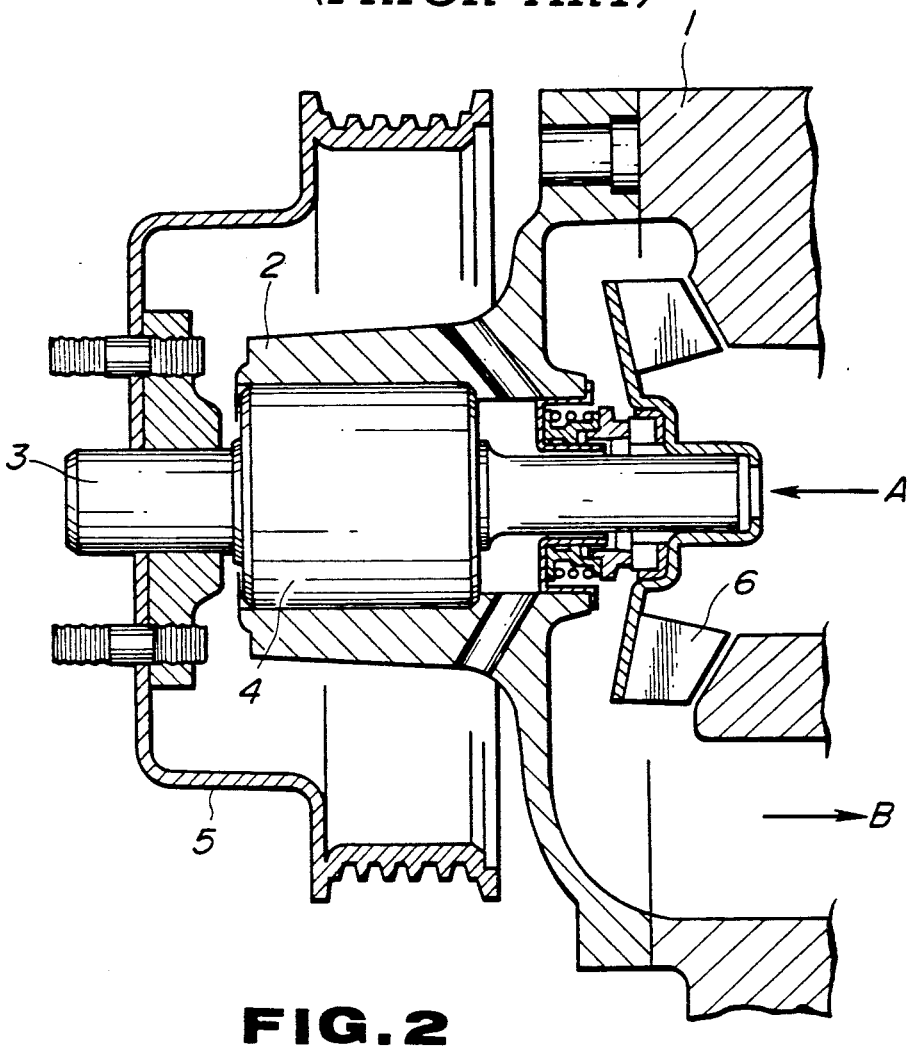
FIG. 1 (PRIOR ART)
FIG. 1 is a sectional view illustrating a conventional impeller type water pump.
Figure 2:
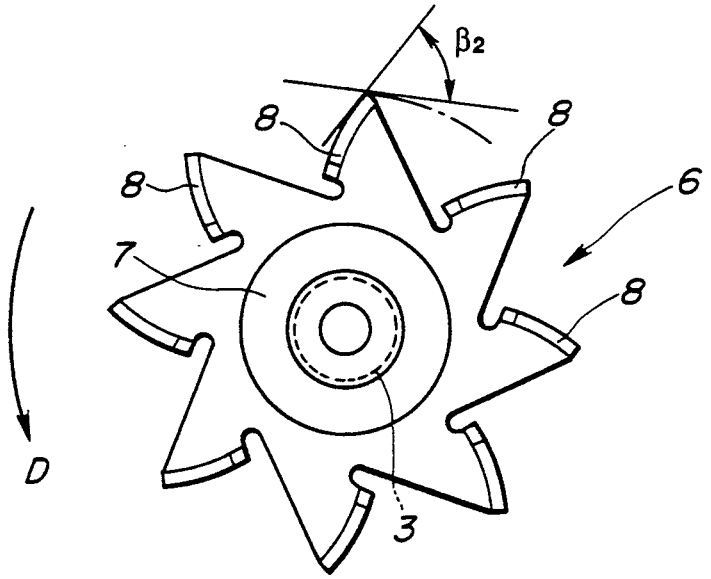
FIG. 2 (PRIOR ART)
FIG. 2 is a plan view illustrating the pump impeller of the water pump of FIG. 1.

In the preferred embodiment, the same reference numerals used to designate elements in the prior art impeller type water pump shown in FIGS. 1 and 2, will be applied to corresponding elements used in the embodiment for the purpose of simplification of the disclosure.

Figure 3:
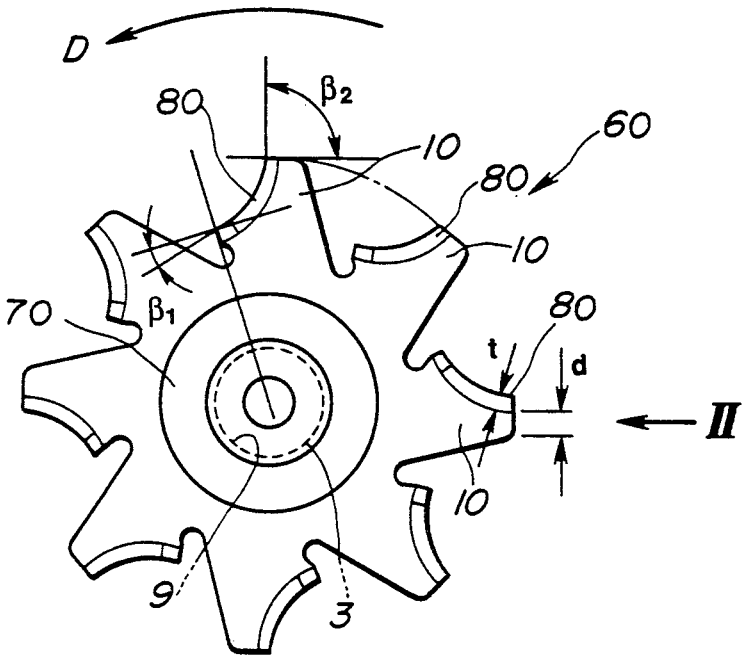
FIG. 3 is a plan view illustrating one embodiment of an impeller applied to a pump according to the invention.
Figure 4:
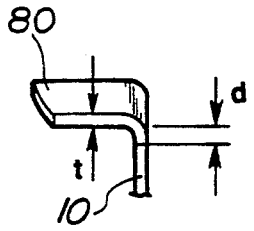
FIG. 4 is a perspective view illustrating a portion of a vane of the impeller of the pump, viewed along arrow II of FIG. 3.

Referring now to FIGS. 3 and 4, the impeller 60 of the present embodiment is press formed of one sheet of metal plate material. The impeller 60 is composed of a hub section 70 securely fixed on the end of the pump shaft 3 and a plurality of vanes 80 extending from the outer periphery of the hub section 70 in a substantially radial direction of the shaft. The hub section 70 is secured on the end of the shaft through a concavity 9, such as a key groove used for a key. The vanes 80 are formed in a manner so that one side surface of each radial extension 10 of the plate material is bent at right angles, each extension extending in a substantially radial direction of the hub 70. Thus, the pressure surface faces in the rotational direction of the impeller. Such an impeller is generally formed through one press process. As appreciated from FIG. 3, the pressure surface of each vane 80 is formed in such a manner that the pressure surface is moderately curved from the innermost end of the vane to the outermost end of the vane, upstream in the rotational direction D of the impeller 60. That is, the pressure surface is formed in such a manner as to increase an angle defined between two tangential lines on a point of the pressure surface, from the innermost end of the vane to the outermost end of the vane. One tangential line is perpendicular to a straight line drawn in the radial direction of the impeller from the center of the pump shaft to the point on the pressure surface, while the other tangential line is drawn along the contour of the pressure surface. Both of the tangential lines are included in a same rotational plane of the vane. It is desirable that the pressure surface of the vane 80 is formed concave as clearly seen in FIG. 3. As is generally known, an outlet angle $\beta_2$ is defined between both of the tangential lines, at the outermost end of the vane 80. As appreciated from FIG. 3, in the embodiment, the pressure surface of the vane is formed in such a manner that an angle defined between the previously noted two tangential lines is gradually increased from the innermost end of the vane to the outermost end of the vane. Note that the outlet angle $\beta_2$ is set to a value of approximately 90° and the inlet angle $\beta_1$ of the innermost end of the vane 80 is set to be two times smaller than the outlet angle $\beta_2$ and the pressure surface is concave. As shown in FIGS. 3 and 4, the width d of the extension 10 at the outermost end thereof is designed to be equal to a thickness t of the plate material of the vane 80 or greater than that, so as to insure sufficient rigidity of the vane section and smooth bending of the vane during pressing process.

Figure 5:
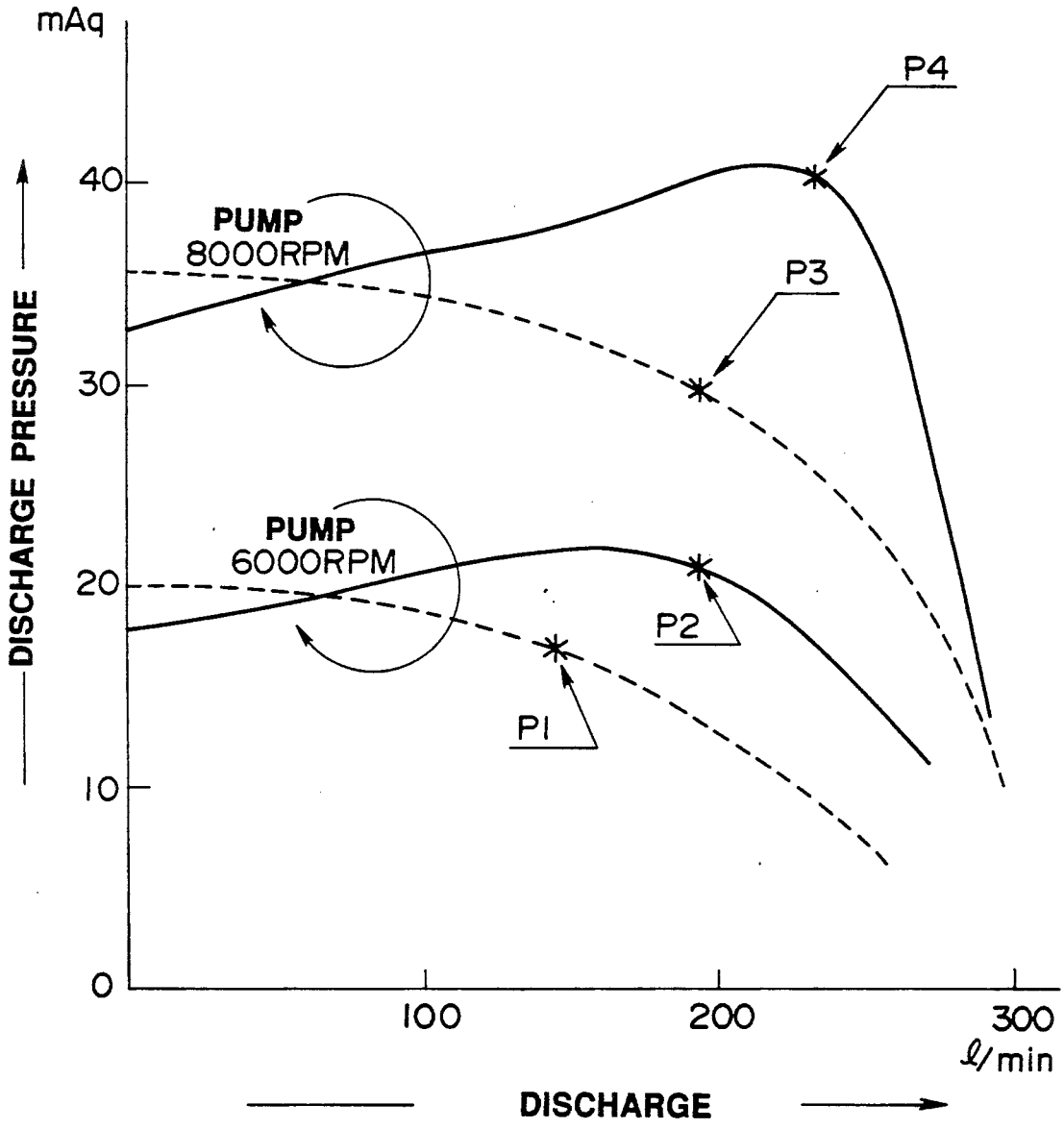
FIG. 5 is pump characteristic curves showing the relationship of discharge pressure and discharge amount at two rotational speeds of the pump impeller, namely 6000 RPM and 8000 RPM.

The pump characteristic curves of both impeller type water pumps, one employing the impeller 60 of the embodiment according to the invention and the other employing the conventional impeller 6, are shown in FIG. 5. These data were experimentally obtained by the inventors of the present invention.

Referring now to FIG. 5, the diagram shows the pump performance relationship between the improved impeller 60 of the invention (shown in solid lines) and the conventional impeller 6 (shown in broken lines), wherein the discharge pressure of fluid is given on the ordinate axis and the discharge of fluid is shown on the axis of abscissa. Uppermost solid line and broken line were measured at the pump rotational speed of 8000 RPM, while lowermost solid line and broken line were measured at the pump rotational speed of 6000 RPM. As appreciated from FIG. 5, as to pump performance, namely the discharge pressure and discharge volume, the impeller of the invention exceeds the conventional impeller in the normal operating range of the pump, that is, at the discharge of fluid 60 l/min or more.

As is generally known, fluid power is expressed by a product of gravitational acceleration, fluid density, discharge volume and discharge pressure of fluid. Assuming that both the gravitational acceleration and the fluid density are constant, the fluid power is determined only by the product of the discharge volume and the discharge pressure of fluid. This means that the fluid power of the improved impeller of the present invention exceeds that of the conventional impeller and thus the pump efficiency of the impeller of the invention exceeds the conventional impeller. In FIG. 5, reference numerals $P_1$ and $P_2$ designate maximum pump efficiency points at a pump revolution of 6000 RPM, utilizing the respective impellers 6 and 60. On the other hand, reference numerals $P_3$ and $P_4$ designate maximum pump efficiency points at a pump revolution of 8000 RPM, utilizing the respective impellers 6 and 60. Based on the test data, the ratio of $P_2/P_1$ is 1.26 at the revolution of 6000 RPM, while the ratio of $P_4/P_3$ is 1.33 at the revolution of 8000 RPM. That is, in the pump utilizing the impeller according to the invention, the pump efficiency is improved by 26% at a pump speed of 6000 RPM and improved by 33% at a pump speed of 8000 RPM.

Although in the preferred embodiment, an improved impeller according to the invention is applied for a water pump for cooling an engine, the impeller structure of the invention may be applied for various kinds of fluid pump.

While the foregoing is a description of the preferred embodiment for carrying out the invention, it will be understood that the invention is not limited to the particular embodiment shown and described herein, but may include variations and modifications without departing from the scope or spirit of the invention as described by the following claims.

What is claimed is:

1. A pump impeller structure for non-elastic fluids comprising:

a plurality of vanes arranged on an impeller body in a substantially radial direction of a pump shaft having a driving connection with the impeller;

each of said vanes including a pressure surface having an outlet angle of approximately 90°, said outlet angle being defined between two tangential lines on a point of said pressure surface lying at the outermost end of the vane, one tangential line being perpendicular to a straight line drawn in the radial direction of the impeller from the center of the pump shaft to said point on said pressure surface and the other tangential line being drawn along the contour of said pressure surface, both of said tangential lines being included in a same rotational plane of the vane, wherein an inlet angle defined between both of said tangential lines at the innermost end of the vane is set to an angle approximately two times smaller than said outlet angle.

2. The pump impeller structure as set forth in claim 1, wherein said pressure surface is arranged such that a point of said pressure surface lying at the outermost end of the vane is located downstream of a point of said pressure surface lying at the innermost end of the vane, with regard to a rotational direction of the impeller.

3. The pump impeller structure as set forth in claim 2, wherein said pressure surface faces in the rotational direction of the impeller.

4. The pump impeller structure as set forth in claim 2, wherein said pressure surface is formed concave in a manner so as to be curved from the innermost end of the vane to the outermost end of the vane.

5. The pump impeller structure as set forth in claim 4, wherein an inlet angle defined between both of said tangential lines at the innermost end of the vane is set to an angle approximately two times smaller than said outlet angle.

6. A water pump impeller structure for internal combustion engines comprising:

a plurality of vanes arranged on an impeller body in a substantially radial direction of a pump shaft having a driving connection with the impeller;

each of said vanes including a pressure surface having an outlet angle of approximately 90°, said outlet angle being defined between two tangential lines on a point of said pressure surface lying at the outermost end of the vane, one tangential line being perpendicular to a straight line drawn in the radial direction of the impeller from the center of the pump shaft to said point on said pressure surface and the other tangential line being drawn along the contour of said pressure surface, both of said tangential lines being included in a same rotational plane of the vane, wherein an inlet angle defined between both of said tangential lines at the innermost end of the vane is set to an angle approximately two times smaller than said outlet angle, and said pressure surface is formed concave in a manner so as to be curved from the innermost end of the vane to the outermost end of the vane.

* * * * *